United States Patent [19]

Holmgren et al.

[11] 3,994,096

[45] Nov. 30, 1976

[54] VENTILATION DEVICES, IN PARTICULAR SMOKE AND HEAT VENTILATION DEVICES

[75] Inventors: Kjell Åke Bertil Holmgren, Trelleborg; Per-Arne Lindholm, Malmo, both of Sweden

[73] Assignee: Aktiebolaget Svenska Icopalfabriken, Sweden

[22] Filed: Apr. 21, 1975

[21] Appl. No.: 570,235

[30] Foreign Application Priority Data

Apr. 23, 1974 Sweden ..... 7405421

[52] U.S. Cl. ..... 49/379; 49/2; 16/54

[51] Int. Cl.[2] ..... E05F 1/06

[58] Field of Search ..... 42/1, 2, 379; 16/54

[56] References Cited

UNITED STATES PATENTS

| | | | |
|---|---|---|---|
| 2,434,524 | 1/1948 | Swanson | 16/54 |
| 2,493,116 | 1/1950 | Diebel | 16/54 X |
| 3,512,210 | 5/1970 | Ratcliffe | 16/54 X |
| 3,800,687 | 4/1974 | Nozawa | 49/2 X |

*Primary Examiner*—Kenneth Downey
*Attorney, Agent, or Firm*—Bucknam and Archer

[57] ABSTRACT

Ventilation device with a vent pivotally mounted in a frame and restrained against opening forces by a locking mechanism and also connected to the frame by a hydraulic brake or damper designed to gradually reduce the opening speed of the vent at least towards the end of the opening movement.

5 Claims, 5 Drawing Figures

VENTILATION DEVICES, IN PARTICULAR SMOKE AND HEAT VENTILATION DEVICES

Figure 1:
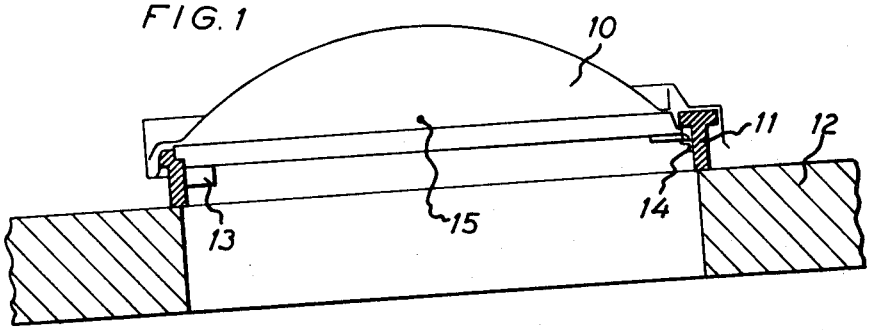

Roof vents are often mounted in industrial and other buildings to serve as extraction vents, in particular as smoke and heat extraction vents. The roof vents may be designed as domed roof windows so that they can be installed among other skylight constructions in the area to be ventilated. The prior art ventilation devices are often designed as vents which are opened when ventilation is needed, the vents being opened by means of the energy stored in the ventilation device, for example, in the form of potential energy in the vent or tension energy in opening springs. Opening of the vent should be effected rapidly at least in the initial stage and, moreover, the vent should offer resistance against closing as a result of draughts which can occur, for example, during a fire. However, the prior art ventilation devices are unsatisfactory in a number of ways, for example, the vent cannot be caused to uncover the major part of the window opening, since a brake in the form of a spring associated with the device would not have time to stop the vent before it reaches too large an opening angle as a result of its impetus. Such a poor braking effect can entail that the vent strikes or collides with some fixed constructional detail, for example a pillar or a wall in the vicinity of the opening, before the vent assumes its position of rest in the open state. At worst, such a collision can cause damage to the object hit by the vent and also to the vent itself. An other disadvantage is that the roof vent in the prior art ventilation devices — because of the inertia forces in the roof vent during the opening procedure — will often overshoot its position of rest determined by the torque and the brake spring force, causing a certain pendulation about the position of rest.

Another disadvantage inherent in the prior art ventilation devices is that the great forces during the opening procedure of the vent will be transferred, as reaction forces, to the frame and consequently to the roof. These reaction forces are great and can cause damage to the mounting of the frame in the roof and to the sealing layer of the roof.

One of the objects of the present invention is, therefore, to provide a ventilation device which constitutes an improvement on the prior art ventilation devices as regards function and safety. Other objects and advantages of the present invention will be apparent from the following description.

Thus, the present invention relates to a ventilation device, in particular a smoke and heat extraction vent, having a frame mounted in an opening in the roof and a vent pivotally mounted by hinge means in the frame and a locking mechanism which is arranged to retain the vent in the closed position against the action of the energy stored in the ventilation device, until such time as the locking mechanism is released and the stored energy is liberated so as to swing the vent to the open position. According to the invention, the ventilation device is provided with a hydraulic braking means constantly connected between the vent and the frame, the braking means being so designed as to permit a relatively high opening speed of the vent at the commencement of the opening movement of the vent as a result of the release of the locking mechanism, and to gradually reduce the opening speed of the vent at least towards the end of the movement of the vent towards the open position until all of the energy stored in the ventilation device for opening the vent has been consumed.

Figure 2:
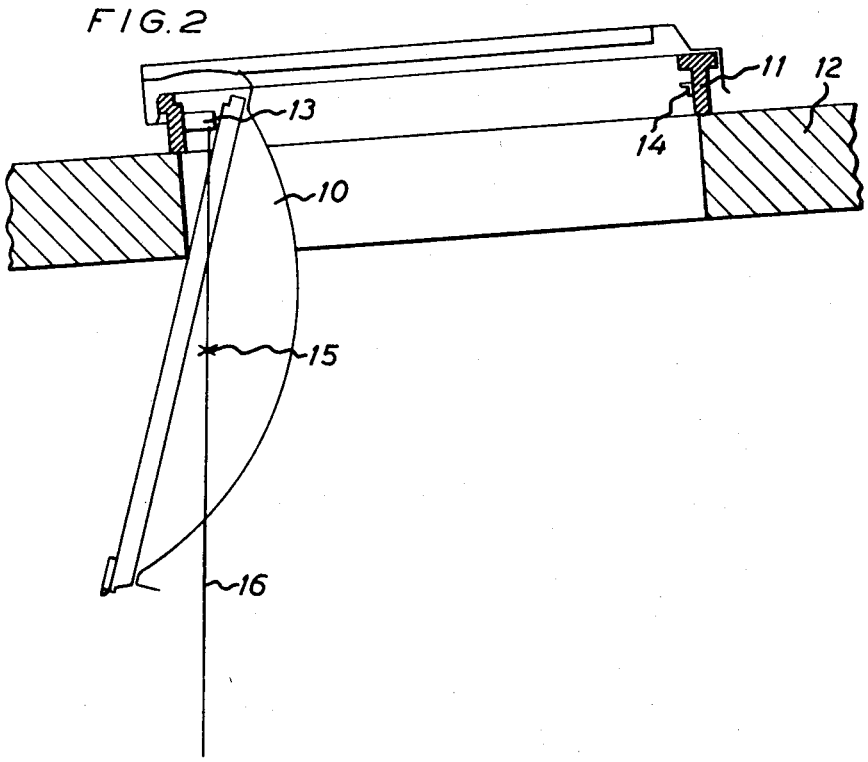
Figure 3:
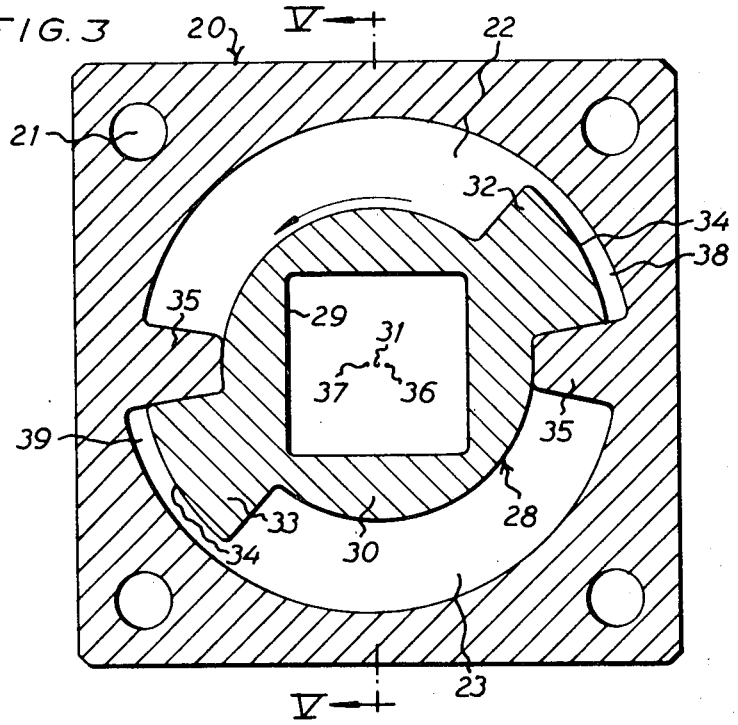
Figure 5:
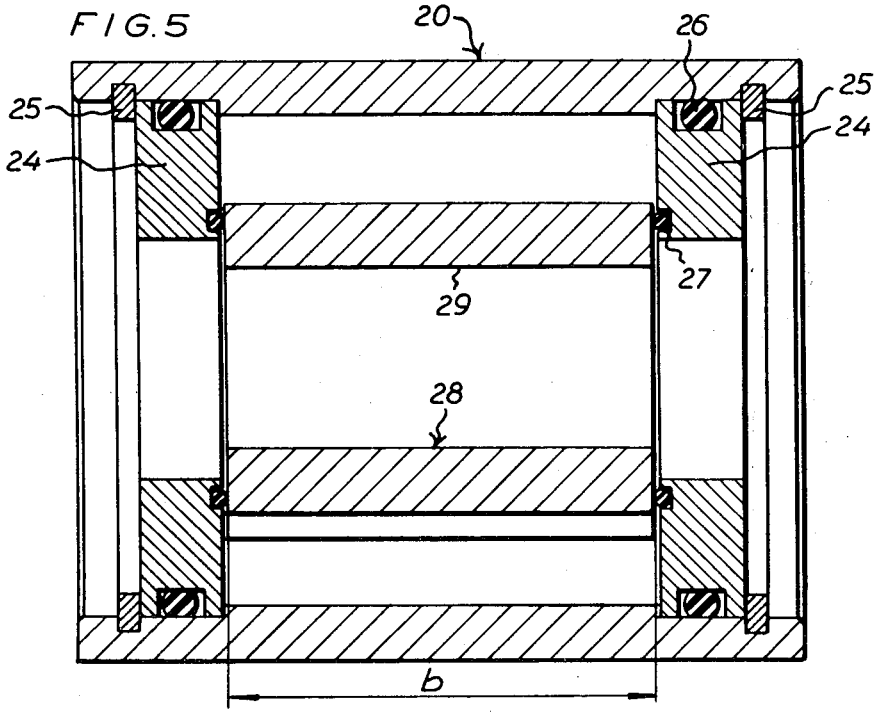
Figure 4:
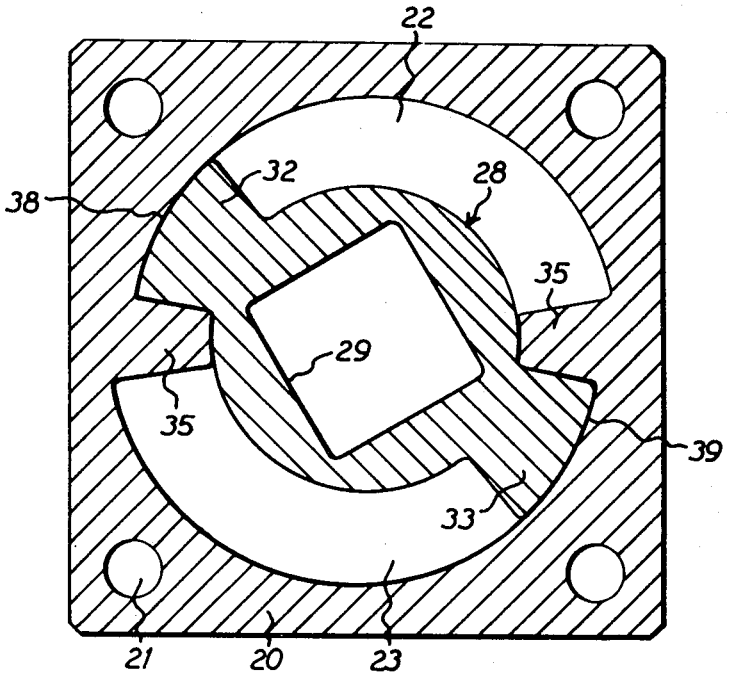

The invention will be described in greater detail hereinbelow and with reference to the following drawings on which;

FIGS. 1 and 2 illustrate a smoke and heat extraction vent according to the present invention in the closed and opened positions, respectively; and FIGS. 3–5 illustrate an embodiment of a braking and damping device associated with the ventilation device according to the invention, FIG. 3 showing a cross-section of the brake in an operative position, FIG. 4 showing the same cross-section with the brake in another operative position, and FIG. 5 showing a longitudinal section along the line V—V in FIG. 3.

FIG. 1 schematically illustrates a smoke and heat extraction vent 10 which is designed as a transparent or translucent domed roof window pivotally mounted in the frame 11 round an opening in the roof 12. The vent 10 is pivotally connected to the frame by hinge means 13 and is normally maintained in the closed position by means of a locking mechanism 14. When ventilation is necessary, for example, in the event of a fire, the locking mechanism 14 is released so that the energy stored in the vent is liberated and, if there is nothing in the way, the vent will swing down to an opened position in which the centre of gravity 15 of the vent lies directly beneath the hinge means 13. This is an essential difference over prior art smoke and heat extraction vents in which the connection line between the hinge 13 and the centre of gravity 15 makes an angle with the vertical 16, since braking devices utilized in conjunction with prior art extraction vents must be adjusted such that the vent is stopped at the end of its downward swing, and to this end it is necessary that the vent, if it is in the position shown in FIG. 2, be actuated in a direction towards the closed position. For a state of equilibrium between the braking force and the torque acting upon the vent it is then required that the vertical 16 and the connection line between the hinge means 13 and the centre of gravity 15 make a certain angle.

According to the invention, the smoke and heat extraction device includes a hydraulic damper which is arranged such that it permits a relatively high opening speed of the vent at the commencement of the opening movement of the vent and that it gradually reduces the opening speed of the vent at least towards the end of the opening movement of the vent until all of the energy stored in the ventilation device for opening purposes has been consumed.

An example of a hydraulic damper which can be utilized in conjunction with the present invention is illustrated in FIGS. 3–5. This hydraulic damper has a housing 20 with fixation holes 21 so that the housing can be attached, for example, to the frame 11 of the roof vent. In the illustrated embodiment there is provided in the housing a chamber divided into two compartments 22, 23 which are hydraulically sealed from each other and contain a viscous liquid. The housing 20 is closed by means of end walls 24 which are fixedly retained in place by locking rings 25. The end walls 24 are formed with two sealing-ring grooves in which are lodged sealing rings 26,27. The sealing rings 26 provide a seal between the interior of the housing and the peripheral edge of the end wall. The sealing ring 27 seals against the end surfaces of a rotor 28 inserted in the housing. This rotor 28 has a through hole 29 for accommodating a shaft or journal, whose rotational movement is to be damped. The rotor 28 has a roughly circular-cylindrical portion 30 whose geometric centre lies at the point 31. Moreover, the rotor has two rotor blades 32, 33 operating in the compartments 22 and 23, respectively. In the illustrated embodiment, these rotor blades have a substantially circular-cylindrical peripheral surface 34.

Both of the compartments 22 and 23 are hydraulically sealed in relation to each other because the sealing rings 27 are sealingly pressed against the end surfaces of the circular-cylindrical portion 30 of the rotor, and because the outer surfaces of the circular-cylindrical portion of the rotor cooperate with matching surfaces of two projections 35 on the inner side of the housing 20.

In the illustrated embodiment, the housing 20 is formed from two semi-cylindrical compartments which are laterally offset in relation to each other and in relation to the axis of rotation of the rotor. Thus, the outer surface of the compartment 22 has its centre at point 36, while the circular-cylindrical outer surface of the compartment 23 has its centre at point 37. As a result of the above-described lateral offset, the gaps 38, 39 between the inner side of the housing and the outer surface 34 of each respective rotor blade 32, 33 will vary in size in dependence upon the position of adjustment of the rotor. This is apparent from a comparison between FIGS. 3 and 4. In FIG. 3, the rotor is shown in the position it assumes when the ventilation device is in the closed position, as shown in FIG. 1. On the other hand, FIG. 4 shows the position assumed by the rotor 28 when the extraction vent is fully open in accordance with FIG. 2.

The damping device functions as follows. When the smoke and heat extraction vent 10 is closed and the rotor 28 connected to the shaft of the vent is in the position shown in FIG. 3, both of the gaps 38, 39 are thus large. When the locking mechanism 14 is released so that the energy stored in the vent is liberated, the vent will begin its opening movement. The speed of this movement will, at the commencement of the opening process, be high, partly because the torque acting upon the vent is great at the initial stage, and partly because the gaps 38, 39 are large so that the gaps constitute only a weak barrier gainst the flow of the viscous liquid through the gaps 38, 39 over to the other side of the rotor blades. As the vent opens further, the size of the gaps 38, 39 is reduced so that resistance to the flow of viscous liquid past the blades 32, 33 successively increases. As a result, the opening speed of the vent will also successively decrease and the opening movement will thus be gently damped and is not terminated until the centre of gravity 15 of the vent is located directly beneath the hinge means 13 or until the vent 10 has encountered some fixed hinder.

Thus, the illustrated braking device exercises its greatest braking effect at the end of the opening phase of the vent. This entails in turn that the brake exercises a great braking effect also when the vent is actuated in the closing direction. This braking effect is greatly advantageous in particular for smoke and heat extraction vents, since the outward draught through the vent can be powerful in the event of a fire. This high braking effect, when the vent is open, forms an utter contrast to that of the prior art ventilation devices in which the brake springs are utilized to arrest the opening movement. As a matter of fact, the brake springs actuate the vent in the closing direction when the prior art vents assume their position of rest in the open state.

The above-described embodiment of the damper has proved to be particularly advantageous, but a similar, if not quite as powerful, effect can be achieved even if the gaps 38, 39 were to remain the same size despite the position of rotation of the rotor. The reason for this is that the torque of the roof vent diminishes the closer vent comes to its open position of rest.

Another great advantage inherent in the apparatus according to the present invention is that the braking of the opening movement of the extraction vent is effected in such a gentle fashion that no reaction forces which could be damaging to the mounting of the frame 11 in the roof 12 are transferred to the frame and the roof. A further advantage is that one and the same damper can be used for smoke and heat extraction vents intended for differently sloping roofs. Thus, if it is desired to use the prior art extraction vents which are provided with a torsion spring to arrest the opening movement, for differently sloping roofs, the spring must be exchanged so that the correct angle of opening is obtained.

The apparatus according to the invention possesses many advantages hitherto lacking in prior art ventilation devices of the type contemplated. The hydraulic braking device or damper thus permits a high speed during the first part of the opening phase of the vent and moreover damps the movement more powerfully towards the end of the opening phase so that the vent assumes its position of rest without first pendulating about said position of rest before complete immobility is achieved. Moreover, the braking device permits a maximum opening, because it does not, like the prior art vents, tend to move the vent towards the closed position. In other words, this maximum opening is also at its maximum with regard to the energy stored in the closed vent and usable for opening purposes. This entails, in turn, that one and the same braking device can be used for different vents independent of the slope of the roof in which the vent is to be mounted. Because the damper exercises a great resistance to swinging movements when the vent is in its open position, it is difficult for draughts, for example from a fire, to close the vent. Furthermore, the damper or braking device possesses the advantage that it is possible to close the vent without having to disconnect some form of locking mechanism. Moreover, in the embodiment of the braking device shown on the drawings, the resistance to closing is reduced at the end of the closing movement, and in actual fact it is possible to cause the brake to release just before the vent arrives at its closed position so that it is noticeable when the vent locks.

The damper or the braking device can be designed with varying gaps to intensify the braking effect in the final phase of the opening movement of the vent, but is preferably designed with uniform gaps. Both of the embodiments provide a diminishing speed at the end of the opening procedure, since the torque decreases the closer the vent comes to the open position. Because of the construction of the damper, it can be used for vents of different sizes and different weights, and the only difference will be that the opening speed becomes greater if the vent is heavier. It should be observed that prior art braking devices in vents of the type in question must be dimensioned for the torque of each vent and the respective roof slope, it being always necessary to incorporate a "safety margin" for swinging movements.

Still another great advantage inherent in the device according to the invention is that it is extremely simple to manufacture and can be produced, for example, by extrusion of profiles which when cut to length immediately impart to the housing and the rotor their general forms. The only requirement is to mill ledges for the end walls 24 and grooves for the locking rings 25. The rotor 28 is loosely lodged in the housing 20 and, for this reason, requires no machining. Alternatively, the braking device or damper can be produced by pressure casting.

What we claim and desire to secure by Letters Patent is:

1. Ventilation device, in particular a smoke and heat extraction vent, having a frame mounted in an opening in the roof and a vent pivotally mounted by hinge means in said frame, and a locking mechanism arranged to retain the vent in the closed position against the action of the energy stored in the ventilation device until the locking mechanism is released and the stored energy is liberated so as to swing the vent to the open position, comprising a hydraulic braking means constantly connected between the vent and the frame and designed to permit a relatively high opening speed of the vent at the commencement of the opening movement of the vent caused by the release of the locking mechanism and, to gradually reduce the opening speed of the vent at least towards the end of the opening movement of the vent towards the opening position until all of the energy stored in the ventilation device for opening the vent has been consumed, wherein said braking means comprises a housing with a closed chamber which contains a viscous liquid and in which is rotatably disposed a rotor having at least one projecting rotor blade, a gap being located between the projecting blade or blades and the wall, the wall being so shaped that the size of the gap varies in dependence on the angle of rotation of the rotor in relation to the housing, and said rotor being directly connected to the frame and said housing being directly connected to the vent or vice versa.

2. Ventilation device according to claim 1, wherein the hydraulic braking means is part of the hinge means of the ventilation device.

3. Ventilation device according to claim 1, wherein the closed chamber in said housing has two or more compartments which are symmetrically disposed in relation to one another and hydraulically sealed from one another, said compartments containing the viscous liquid and each accommodating one rotor blade.

4. Ventilation device according to claim 3, wherein the compartments of said closed chamber are laterally offset in relation to each other and in relation to the axis of rotation of said rotor.

5. Ventilation device according to claim 4, wherein the compartments laterally offset in relation to one another have a substantially circular-cylindrical outer circumferential surface.

* * * * *